US006193118B1

(12) United States Patent
Kearl

(10) Patent No.: US 6,193,118 B1
(45) **Date of Patent: *Feb. 27, 2001**

(54) ORGANIZER WITH WORK SURFACE

(75) Inventor: Monica Meyer Kearl, Mantua, UT (US)

(73) Assignee: Jamin, Inc., Mantua, UT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/987,657

(22) Filed: Dec. 9, 1997

(51) Int. Cl.[7] ..... A45F 4/02

(52) U.S. Cl. ..... 224/153; 224/627; 224/645; 224/652; 224/655; 108/43; 383/4; 206/1.7; 206/575; 150/104; 150/145; 190/11; 190/114

(58) Field of Search ..... 224/153, 575, 224/576, 577, 627.6, 630, 645, 650, 652, 235, 236, 237, 655; 108/43; 150/103, 104, 105, 143, 145, 131; 190/1, 11, 114; 383/4; 206/1.7, 575

(56) References Cited

U.S. PATENT DOCUMENTS

| | | | | |
|---|---|---|---|---|
| 1,206,276 | * | 11/1916 | Wallch | 190/114 |
| 2,302,560 | * | 11/1942 | Latona | 150/104 X |
| 2,324,194 | * | 7/1943 | Campiglia | 224/153 X |
| 2,446,009 | * | 7/1948 | Hyman | 150/143 |
| 2,479,472 | * | 8/1949 | Coplon | 150/145 |
| 2,656,870 | * | 10/1953 | Wishnia | 150/104 |
| 2,789,612 | * | 4/1957 | Rising | 150/145 |
| 3,556,187 | * | 1/1971 | Speakes | 150/104 X |
| 3,575,226 | * | 4/1971 | Chapman | 150/104 |
| 3,881,644 | | 5/1975 | Demaline . | |
| 4,085,873 | * | 4/1978 | Schweitzer | 383/4 |
| 4,126,168 | * | 11/1978 | Ganz et al. | 150/143 |
| 4,236,657 | * | 12/1980 | Brunton | 224/153 |
| 4,515,493 | * | 5/1985 | Radovich | 190/11 |
| 4,609,084 | | 9/1986 | Thomas | 190/110 |
| 4,634,032 | | 1/1987 | LaFlame | 224/265 |
| 4,874,340 | | 10/1989 | Smallwood | 446/28 |
| 4,946,292 | | 8/1990 | Diamond et al. | 383/127 |
| 5,030,014 | | 7/1991 | Diamond et al. | 383/127 |
| 5,044,537 | | 9/1991 | Bufalo | 224/245 |
| 5,134,930 | * | 8/1992 | Mei-Hwa | 108/43 |
| 5,222,642 | * | 6/1993 | Solarz | 224/645 |
| 5,388,530 | * | 2/1995 | Jacobus | 108/42 |
| 5,400,906 | | 3/1995 | Tang | 206/457 |
| 5,447,215 | * | 9/1995 | Volkmar et al. | 190/11 |
| 5,467,853 | * | 11/1995 | Pelletier | 190/11 |
| 5,499,874 | | 3/1996 | Tang | 383/127 |
| 5,564,539 | | 10/1996 | Duensing | 190/107 |
| 5,570,828 | | 11/1996 | Lewis | 224/627 |
| 5,570,829 | | 11/1996 | Harrison | 224/651 |
| 5,630,537 | * | 5/1997 | Sciacca | 224/629 |
| 5,649,658 | | 7/1997 | Hoffman et al. | 224/576 |
| 5,680,973 | * | 10/1997 | Vulpitta et al. | 224/629 |

FOREIGN PATENT DOCUMENTS

| | | | | |
|---|---|---|---|---|
| 167038 | * | 4/1950 | (AU) | 224/209 |
| 2099180 | | 12/1994 | (CA) . | |

(List continued on next page.)

*Primary Examiner*—Gregory M. Vidovich
(74) *Attorney, Agent, or Firm*—Workman, Nydegger & Seeley; David B. Dellenbach

(57) ABSTRACT

The organizer of the present invention has (a) a panel, (b) a work surface; and (c) a rim for coupling the work surface to the panel. Preferably, the panel is part of a backpack. The work surface is light permeable and a space exists between the work surface and the panel for placement of a sheet of paper or other object between the work surface and the panel. Static electricity maintains the sheet of paper against the work surface in a removably affixed position. The sheet has indicia thereon which are observable through the work surface.

20 Claims, 6 Drawing Sheets

FOREIGN PATENT DOCUMENTS

| | | | | | |
|---|---|---|---|---|---|
| 111393 | * | 7/1964 | (CS) | ..... | 150/103 |
| 623012 | * | 12/1935 | (DE) | ..... | 224/209 |
| 89170 | * | 3/1870 | (FR) | ..... | 224/209 |
| 385967 | * | 1/1908 | (FR) | ..... | 206/1.7 |
| 1108023 | * | 1/1956 | (FR) | ..... | 150/105 |
| 2706119 A1 | * | 12/1994 | (FR) | ..... | 224/209 |

* cited by examiner

ORGANIZER WITH WORK SURFACE

BACKGROUND OF THE INVENTION

1. Invention Disclosure

An embodiment of this invention was described in an invention Disclosure Document, No. 419,974, filed on May 27, 1997, which is incorporated herein in its entirety by reference.

2. The Field of the Invention

This invention is in the field of organizers. More specifically, this invention relates to backpacks containing supplies and tools.

3. The Relevant Technology

Writing and drawing are forms of communication and expression which are central to human life and have been for centuries. While a great deal of writing and drawing occurs in an office or home setting in which an individual has ready access to a table or other writing surface, it is common for authors, artists, and draftsmen to travel to remote locations in order to write or draw.

Artists, for example, travel to a scenic environment, a street corner or another remote location in order to record their surroundings on paper. Writers often abandon the busy and hectic atmosphere of urban life in order to find peace in the outdoors, such as in a park, on a beach, or in the mountains. Others attempt to draw or write while traveling in an automobile or airplane.

For each of these writing and drawing enthusiasts, their decision to write or draw in these remote locations presents a variety of advantages, such as those listed, but also presents certain challenges, including finding a convenient writing surface on which to express themselves. For example, upon arriving at a park, a writer must often search for a surface upon which to place a piece of paper in order to begin writing.

It is not uncommon for a writer or artist to carry a clipboard, a pad of paper or a book to a remote location, then draw or write on the pad of paper or on a piece of paper placed on the book, clipboard, or pad. A difficulty associated with typical portable writing supplies, however, is that the writing supplies must be transported by either holding onto the writing supplies, placing the supplies in a vehicle, or placing the supplies in a bag, backpack or other temporary storage container while travelling to the remote location. Upon arriving at a desired destination, the user must remove the paper and a clipboard or a book out of the temporary storage container in order to begin writing or drawing.

While the simple process of removing a piece of paper from a container, then placing the piece of paper onto a surface which permits writing on the paper may not be cumbersome for the individual who has brought a book or clipboard or arrived at a location with a bench, this process is particularly cumbersome when the artist or writer fails to bring a book or clipboard or is confined within an enclosed space, such as an automobile or airplane.

Particularly children are susceptible to becoming frustrated if they would like to entertain themselves in an automobile, airplane, bus, train or other mode of transportation by writing or drawing if their supplies are disorganized and if they must balance a paper on top of a book on their lap. The frustration of children often results in behavioral outbursts, which can result in parental frustration.

In addition to the frustration of transporting a book or clipboard to a remote location in order to provide a surface on which to write, the writing supplies transported also tend to become disorganized and damaged if merely stuffed into a backpack or bag. Although certain backpacks and bags have been designed with pouches and other holding devices, these backpacks and bags are generally designed to be placed away from a specific work area, such as on the floor or in a neighboring chair once the user arrives at a location and removes the writing supplies therefrom.

While it is possible in some circumstances to keep a bag having organizing compartments close by while writing or drawing, such as when the user is sitting at a table and places the bag on the table, it is often inconvenient or impossible to keep the bag with organizing compartments within a work area, such as when riding in an automobile or airplane. Furthermore, since typical backpacks and bags are designed to be comprised of a lightweight, pliable, woven material, the material often used is typically not suitable for writing thereon or for placing a piece of paper thereon in order to write on the paper.

Another related problem within the art relates to workers who carry supplies and tools to remote locations, then desire a work surface upon which to manipulate items. Plumbers, repairmen, electricians, construction workers, and a host of other individuals, for example, often carry supplies and tools to a remote location, then desire a flat area on which to manipulate parts and other objects only to find that they are working in a cumbersome space in which a flat surface is not readily available. While it is possible to carry tools and supplies in a bag or backpack and carry a separate work surface which is suitable for manipulating the tools and supplies on, this practice is often inconvenient and cumbersome.

SUMMARY AND OBJECTS OF THE INVENTION

It is therefore an object of the invention to provide an improved organizer.

It is another object of the invention to provide an article which includes a work surface surrounded by an organizer for organizing items needed during writing, drawing or performing other work on the work surface.

It is another object of the invention to provide a backpack containing an integral work surface.

It is yet another object of the invention to provide a backpack fitted with a variety of pouches designed specifically to contain tools and supplies.

It is another object of the invention to provide a panel having a work surface coupled thereto which includes a space between the panel and the work surface for the placement of insignia-bearing sheets between the work surface and the panel.

It is another object of the invention to provide a panel having a work surface coupled thereto and one or more flaps coupled to the panel.

It is another object of the invention to provide a panel having a plurality of organizing flaps coupled thereto.

The organizer of the present invention comprises (a) a panel, (b) a work surface; and (c) a rim for coupling the work surface to the panel. Preferably, the panel is part of a backpack. The work surface is light permeable and a space exists between the work surface and the panel for placement of a sheet of paper or other object between the work surface and the panel. Static electricity maintains the sheet of paper against the work surface in a removably affixed position. The sheet has indicia thereon which are observable through the work surface.

Thus, the organizer can be used to store objects, such as paper between the panel and the work surface. Once the user is ready to use the organizer, the user can remove the paper from the space between the panel and the work surface and place the paper on the work surface. The organizer can also be used to trace the images of the indicia appearing through the work surface with a marker or other writing instrument. The work surface of the organizer can also be used to manipulate objects and parts stored in the compartments of the organizer.

First and second flaps couple to opposing sides of the panel. Each flap has an interior surface and an exterior surface, the interior surface of one flap selectively folding against the work surface. The flaps may be coupled to each other to prevent the flaps from flailing about when the backpack is transported. Each flap includes one or more pocket, pouch, or an organizing tray coupled thereto for containing tools, writing instruments, supplies or other objects.

The backpack is configured to fit within the lap of a user and the first and second flaps are each configured to drape onto opposing sides of the legs of the user, allowing convenient access by the user to the work surface and to objects coupled to the first and second flaps. Upper and lower flaps are also coupled to opposing upper and lower ends of the panel which allow convenient access by the user.

The organizer is ideal for those interested in having tools, papers, supplies or other items organized adjacent a work surface, such as children, writers, artists, workers, repairmen, travelers, and a variety of other individuals.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
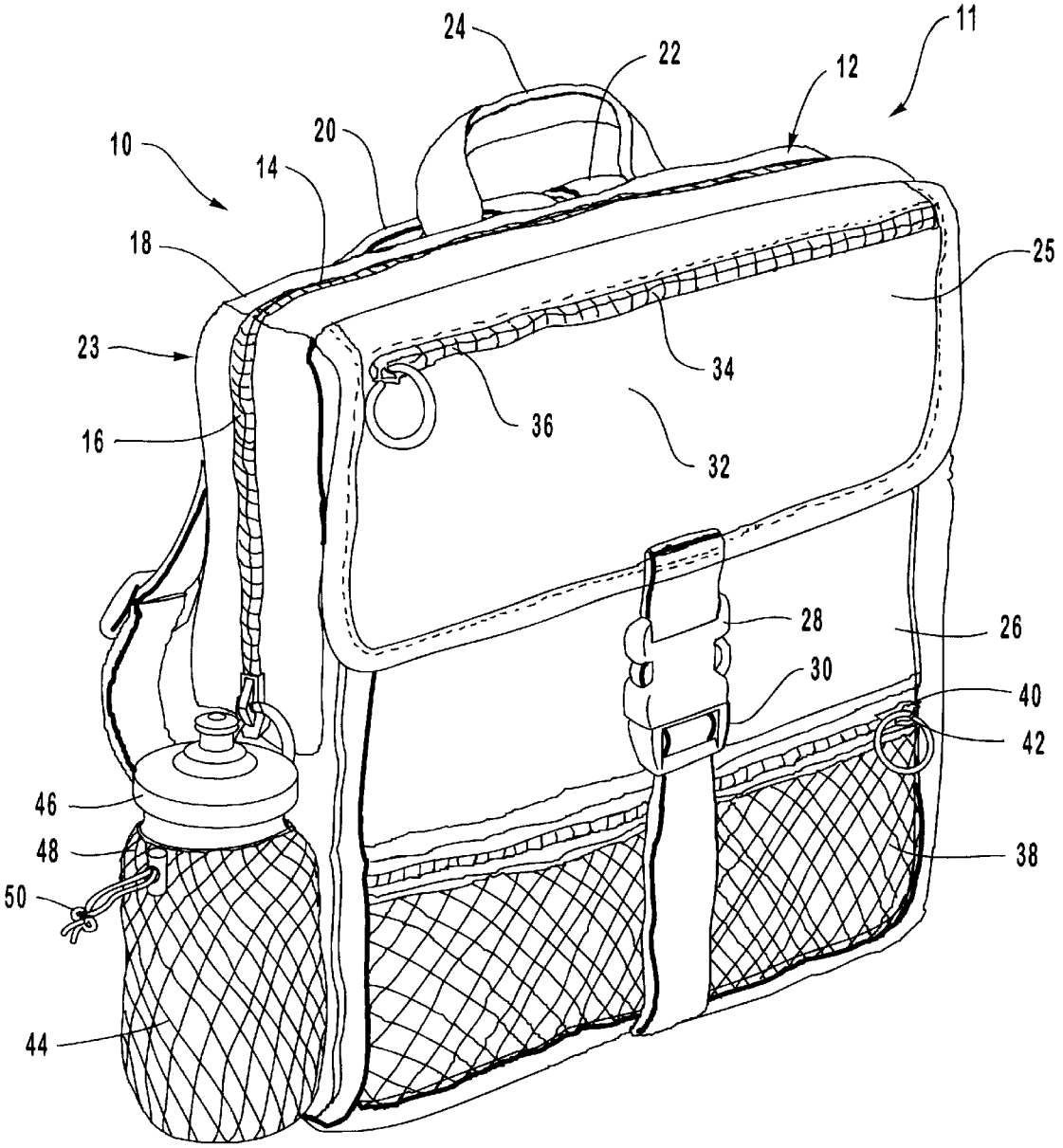
FIG. 1 as a perspective view of a system of the present invention, the system including a backpack with upper, lower, and first and second side flaps each being shown in a folded position.

With reference to FIG. 1, organizer 10 of the present invention will now be described in additional detail. As shown, organizer 10 comprises a backpack 11 having a pouch 12. Backpack pouch 12 has an open end 14 and means for selectively closing open end 14 such as zipper 16. Backpack pouch 12 has an outer surface 18. First and second straps 20, 22 are coupled at opposing upper and lower ends thereof to backpack pouch 12. In addition, a handle 24 is coupled to backpack pouch 12.

Pouch 12 includes a rear panel 23 which includes opening 14. Rear panel 23 couples to a front panel 112 which will be discussed in detail below with reference to FIGS. 3, 4, and 5. Also as shown in FIG. 1, a selectively folding upper flap 25 couples to an upper end of backpack pouch 12 while a selectively folding lower flap 26 couples to a lower end of backpack pouch 12. Upper and lower flaps 25, 26 are shown in a folded position in FIG. 1 with the exterior surfaces thereof exposed.

Organizer 10 further comprises means for removably coupling upper flap 25 to lower flap 26. In the embodiment shown in FIG. 1, the means for removably coupling flaps 25, 26 comprises an upper attachment member 28 on upper flap 25 and a lower, corresponding attachment member 30 on lower flap 26.

Upper and lower corresponding attachment members 28, 30 shown in FIG. 1 comprise respective female and male clip portions. It will be appreciated, however, that attachment members 28, 30 and the other attachment members discussed herein may comprise corresponding male and female clasps, clips, hook and eye fasteners, hook and pile fasteners (such as VELCRO), or a variety of other removable two-part interacting fastening members known to those skilled in the art.

Upper flap 25 includes means for removably coupling an object to upper flap 25. As one example, flap 25 includes pouch 32 having an exterior opening 34 and means for selectively closing exterior opening 34 such as zipper 36. Similarly, lower flap 26 includes means for removably coupling an object to lower flap 26, such as pouch 38 comprised of a mesh material. Pouch 38 has an opening 40 and means for selectively closing opening 40, such as zipper 42.

As another example of means for removably coupling an object to backpack 11, a side pouch 44 is coupled to backpack pouch 12 for receiving a water bottle 46, for example. Pouch 44 comprises an opening 48 and means for selectively closing opening 48, such as drawstring 50.

Figure 2:
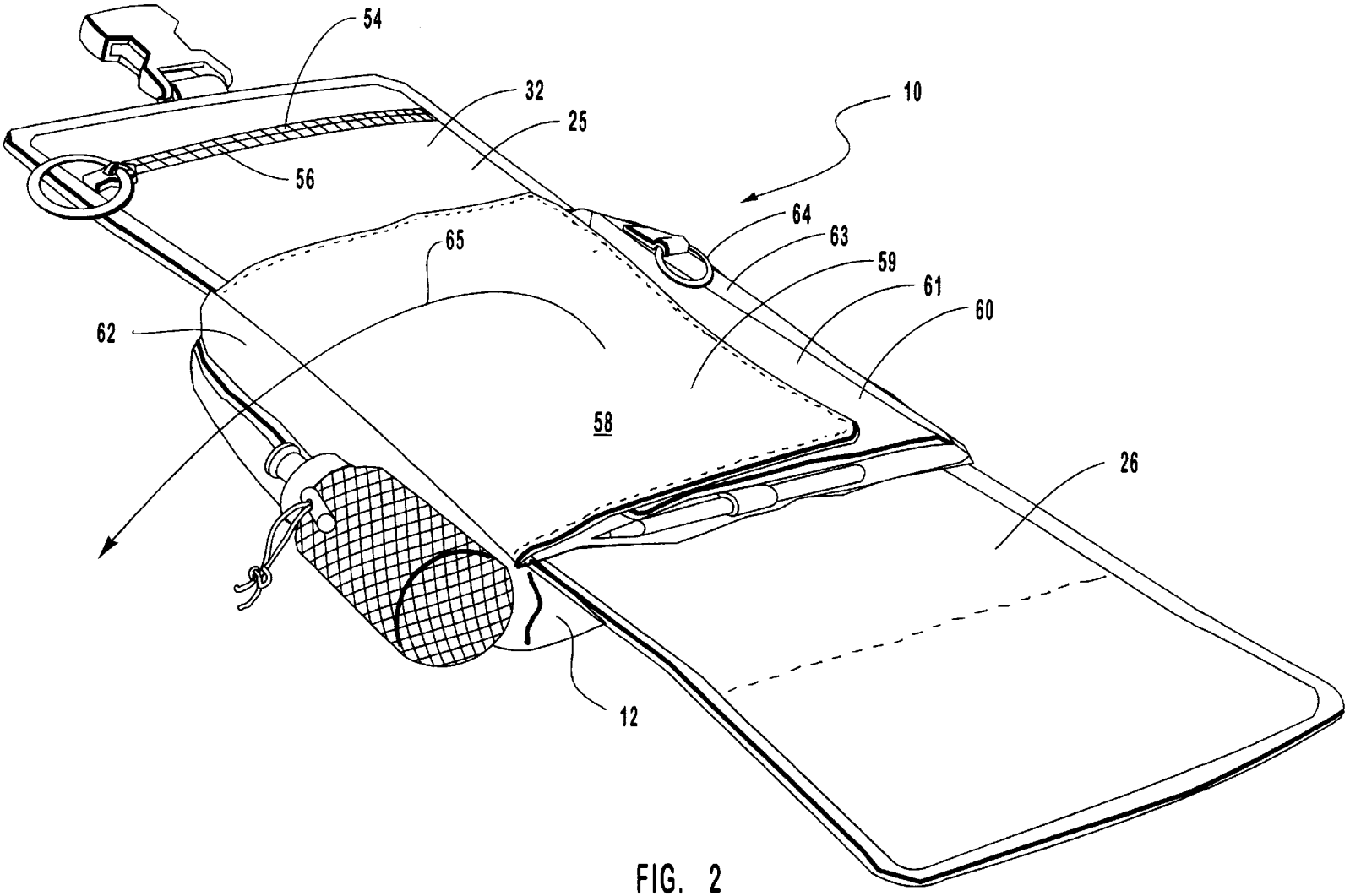
FIG. 2 is a view of the system of FIG. 1 with the top and bottom flaps in open positions and having an arrow demonstrating the direction of opening of a first side flap.

With reference now to FIG. 2, as upper and lower flaps 25, 26 are in an open position, the interior surfaces thereof are revealed An inner opening 54 of pouch 32 is revealed on upper flap 25, along with means for selectively closing opening 54 such as zipper 56. Lower flap 26 may also comprise an inner pouch or other removable coupling means on the interior surface thereof, if desired.

As FIG. 2 also demonstrates, backpack 11 further comprises selectively folding first and second side flaps 58, 60 coupled to opposing sides of backpack pouch 12, each of which are shown in a folded position in FIG. 2. The exterior surfaces 59, 61 of first and second side flaps 58, 60 are shown in FIG. 2. First and second front ends 62, 63 of rear panel 23 are also shown in FIG. 2. A ring 64 is coupled to second front end 63 of pouch 12 for selectively mounting various items to pouch 12. Arrow 65 demonstrates the direction of opening of first flap 58.

Figure 3:
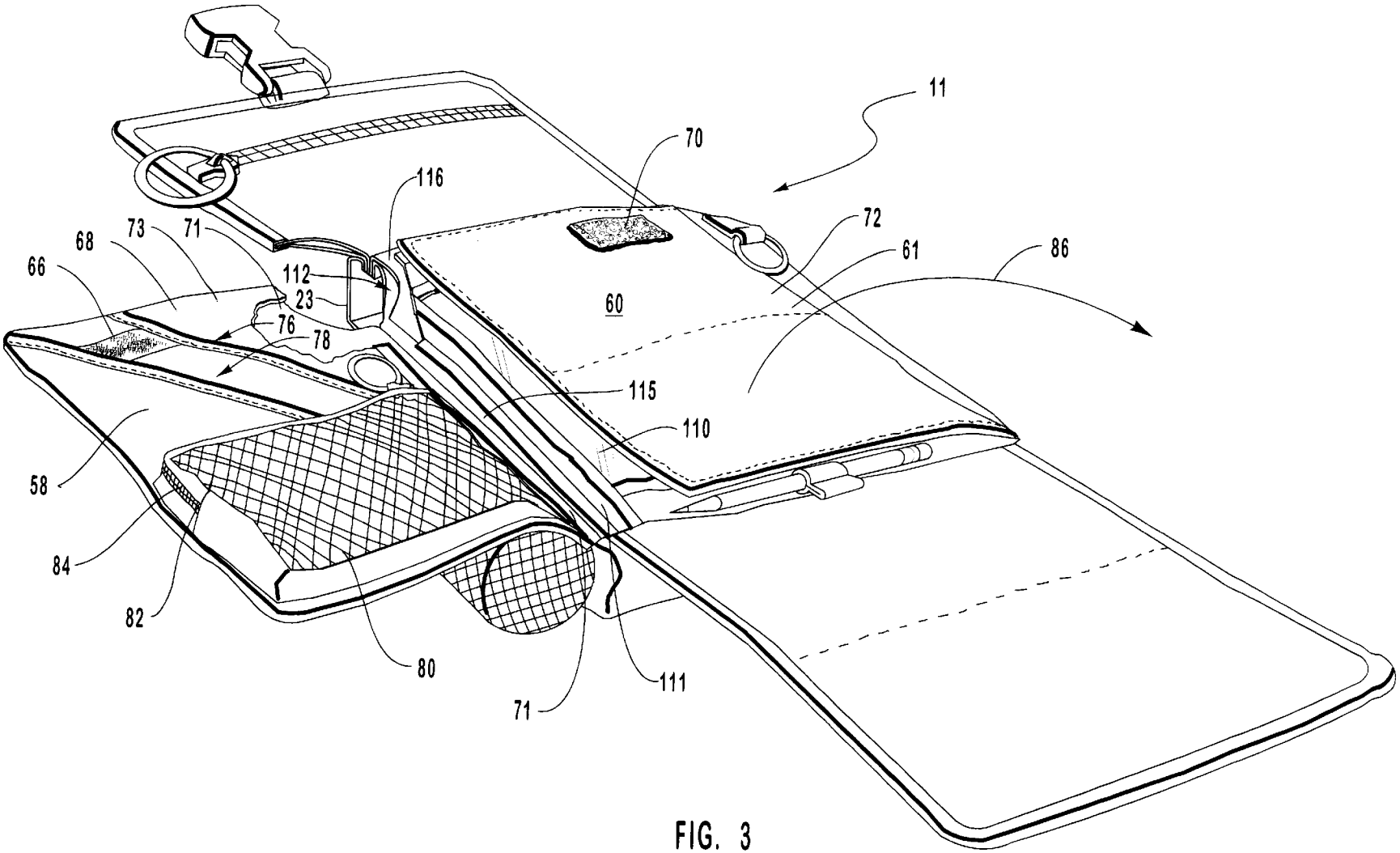
FIG. 3 demonstrates the system of FIG. 1 with the upper and lower flaps opened and with the first side flap in an open position. An arrow demonstrates the direction of opening of a second flap. A top corner of the first side of system is shown in a cutaway view.

FIG. 3 demonstrates organizer 10 with first flap 58 shown in an open position. As shown in FIG. 3, backpack 11 further comprises means for removably coupling first and second side flaps 58, 60 to each other. In the embodiment shown in FIG. 3, the means for removably coupling first and second side flaps 58, 60 comprises a piece of hook material 66 coupled to an interior surface 68 of first side flap 58 and a piece of pile material 70 coupled in a corresponding position on exterior surface 61 of second side flap 60.

The corresponding first and second attachment members 66, 70 are oriented on their respective flaps 58, 60 such that when first flap 58 is folded onto second flap 60 the corresponding attachment members 66, 70 couple to each other. As discussed above, it will be appreciated that the attachment members 66, 70 may be comprised of a variety of different removable two-part interacting members.

First flap 58 includes a number of examples of means for removably coupling an object to first flap 58. As one example, first flap 58 is comprised of first and second sheets 71, 73 in order to form a pocket between first and second sheets 71, 73. As further examples of means for removably coupling an object to flap 58, second sheet 73 has a first diagonal sheet 76, a second diagonal sheet 78 and a first side flap pouch 80 coupled thereto, sheets 76, 78 forming pockets.

Pouch 80 has an opening 82 and means for selectively closing opening 82 such as zipper 84. The pockets formed on flap 58 and pouch 80 may be used to store a variety of different objects such as tools, supplies, snacks, papers, writing tablets, books, pencils, and pens such that the user may readily access and use such materials.

FIG. 3 also demonstrates a work surface 110 coupled to front panel 112 of backpack pouch 12. Second side flap 60 is disposed against work surface 110 in a folded position in FIG. 3.

First and second attachment members 66, 70 collectively serve as an example of means for retaining first and second side flaps 58, 60 in a folded position against work surface 110. As will be appreciated from the view of FIGS. 1, 2, and 3, upper and lower flaps 25, 26 collectively serve as another example of means for retaining first and second side flaps 58, 60 in a folded position against work surface 110. This prevents objects contained within the interior surfaces of flaps 58, 60 from spilling while organizer 10 is transported to another location.

Figure 4:
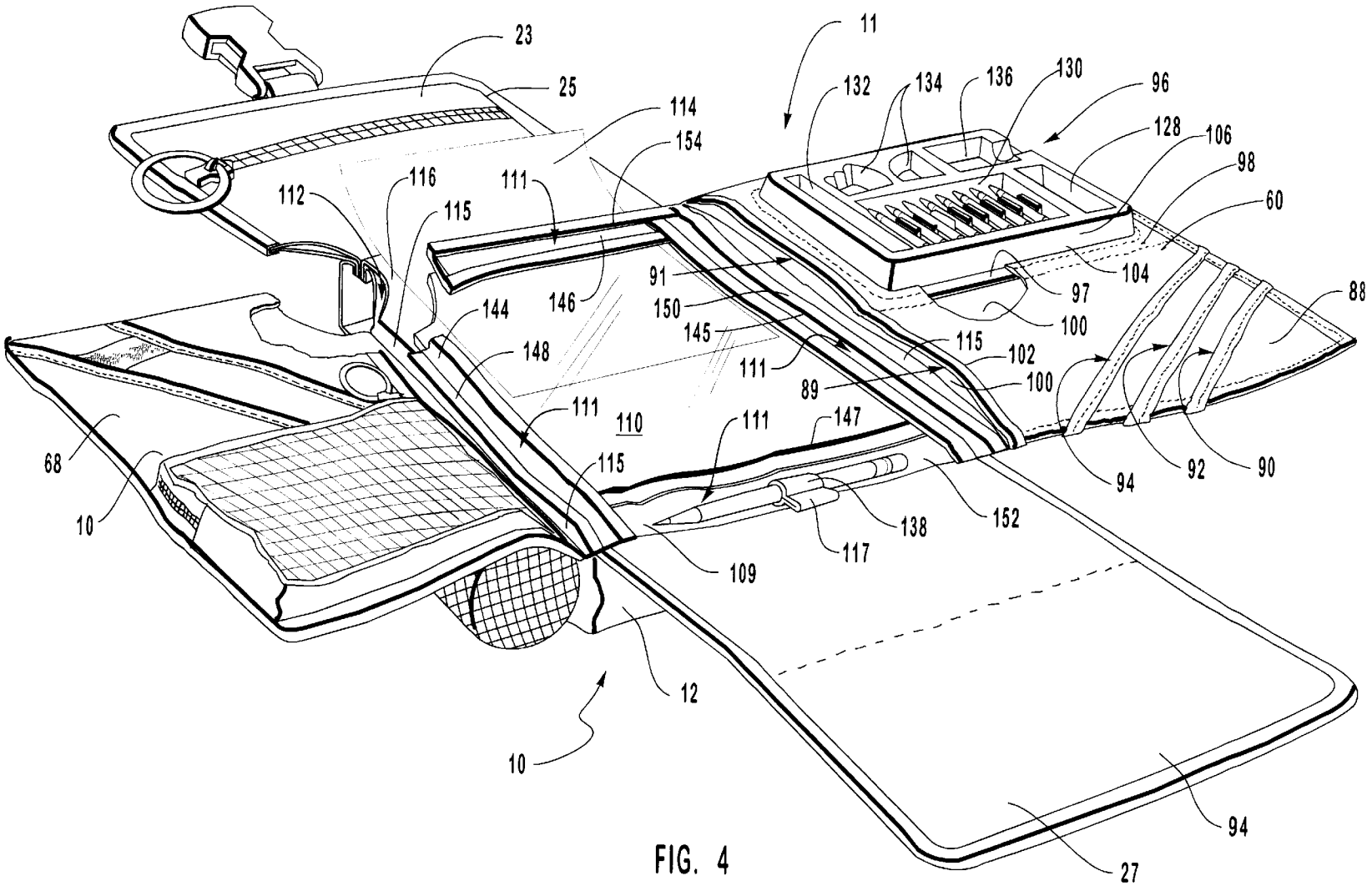
FIG. 4 demonstrates the system of FIG. 1 with the upper and lower flaps in open positions and with the first and second side flaps in open positions. A top corner of the first side of system is shown in a cutaway view.

Arrow 86 shows the direction of opening of second flap 60 when so desired. FIG. 4 demonstrates organizer 10 with upper and lower flaps 25, 26 and first and second side flaps 58, 60 in open positions demonstrating the interior surfaces 23, 27, 68, 88 of upper flap 25, lower flap 26, first side flap 58, and second side flap 60, respectively.

Flap 60 includes a number of example of means for removably coupling an object to flap 60. As one example, flap 60 is comprised of first and second sheets of material 100, 102 stitched in a middle portion thereof in order to form first and second pockets 89, 91. A portion of sheet 102 is broken away in FIG. 4. As additional examples of means for removably coupling an object to flap 60, second side flap 60 further includes a first diagonal pocket 90, a second diagonal pocket 92 and a third diagonal pocket 94 formed on first sheet 100 through the use of diagonal sheets coupled to sheet 102.

As another example of means for removably coupling an object to flap 58, organizer 10 further comprises an organizing tray 96 and means for coupling tray 96 to second flap 60. In the embodiment shown in FIG. 4, the means for removably coupling tray 96 to second flap 60 comprises (i) tray 96 having a lip 97 disposed at approximately a 90° angle to a side 106 of tray 96; and (ii) second sheet 102 having an aperture defined by a rim 98 of sheet 102, rim 98 being disposed about tray 96, such that lip 97 of tray 96 is disposed under rim 98 of sheet 100. In the embodiment of FIG. 4, tray 96 is removably coupled to flap 60. In another embodiment, tray 96 is sewn into flap 60, such as by sewing lip 97 into rim 98.

In one embodiment, tray 96 is a thermoformed tray comprised of a substantially rigid, material such as a thin plastic material and has variety of different recesses for removably receiving various objects. In one embodiment, tray 96 comprises polyvinyl chloride (PVC). The thickness of tray 96 may vary depending upon a desired use. Preferably, tray 96 is thick enough to prevent breakage, yet thin enough to be lightweight. By way of example, in one embodiment, the thickness of tray 96 is between about one eighth of an inch thick and about 1/100 of an inch thick, preferably between about 1/16 of an inch and about 1/64 of an inch thick, more preferably about 0.02 inches thick.

In one embodiment, recess 128 of tray 96 receives a scissor, recess 130 receives a series of crayons, recess 132 receives a marker, recesses 134 receive erasers, and recess 136 receives a pencil sharpener. Tray 96 may also receive tools, parts, and mechanisms for use in home repair, automobile repair, and in a variety of different settings.

Figure 5:
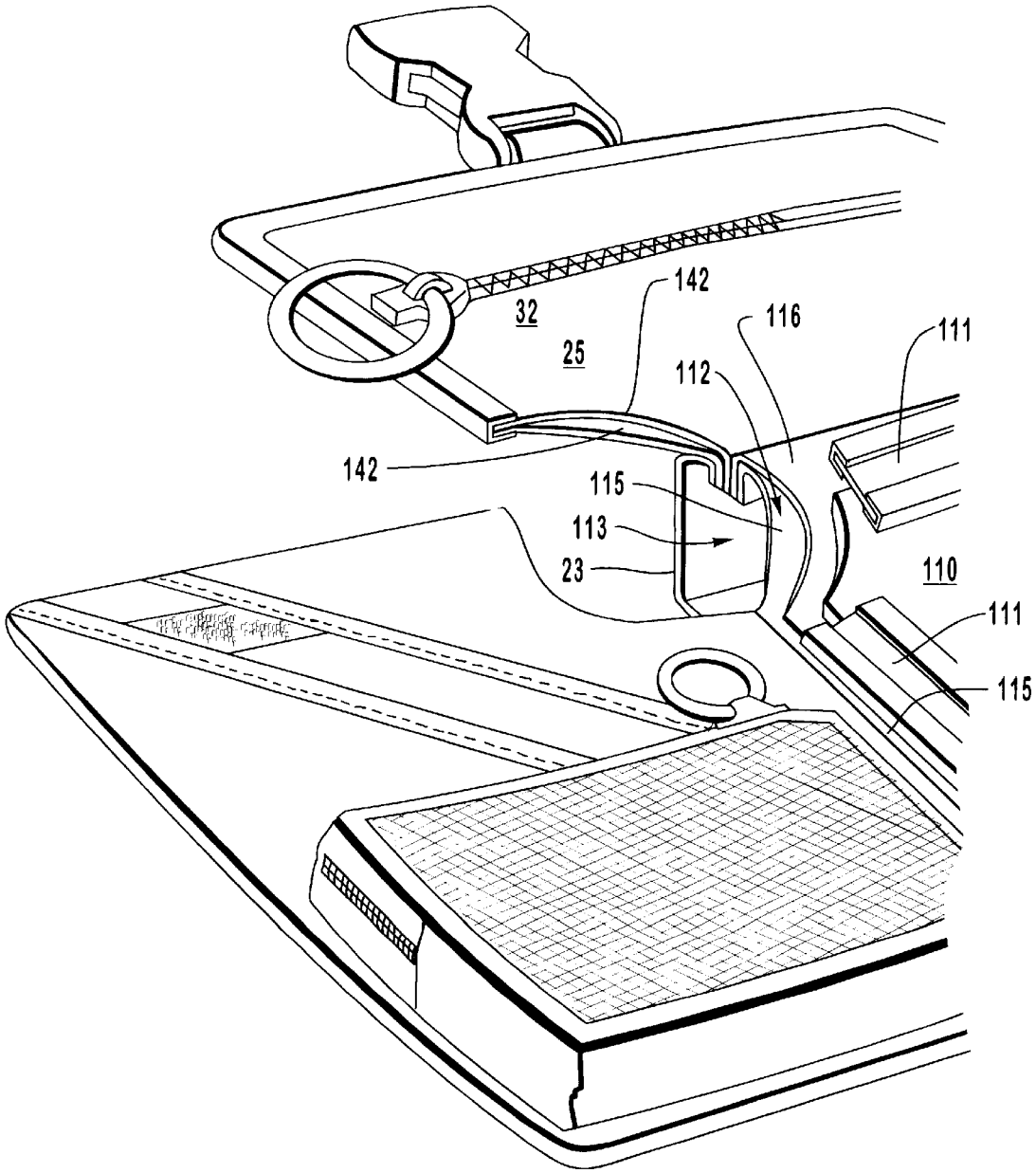
FIG. 5 demonstrates an enlarged view of the cutaway top corner section viewed in FIG. 4.

Front panel 112 of pouch 12 is shown in FIG. 4. Front panel 112 couples to rear panel 23 by being stitched thereto. Preferably, the seam is disposed within an interior surface 113 of pouch 12, as shown in FIGS. 3–5.

FIG. 4 further demonstrates partially cutaway work surface 110 and means on front panel 112 of pouch 12 for coupling work surface 110 to backpack 11. In the embodiment shown, the means for coupling work surface 110 to backpack 11 comprises a rim 111 on a front panel 112 of backpack 11, rim 111 disposed about the peripheral edges of work surface 110 and the peripheral edges of front panel 112 in order to maintain work surface 110 against panel 112.

As used throughout this specification and the appended claims, the term "work surface" refers to any substantially rigid, substantially flat surface. Work surface 110 is preferably comprised of a lightweight, light-permeable material, such as plastic. Work surface 110 as shown in FIG. 4 comprises a rectangular acrylic sheet. However, it will be appreciated that work surface 110 may be comprised of a variety of other substantially rigid, substantially flat materials, including metal and wood. Work surface 110 may also be made of a translucent or opaque material.

The thickness of work surface 110 may vary depending upon a desired use. Preferably, work surface 110 is thick enough to prevent breakage, yet thin enough to be lightweight. By way of example, in one embodiment, the thickness of work surface 110 is between about one half an inch thick and about 1/32 of an inch thick, preferably between about 1/20 of an inch and about 1/4 of an inch thick, more preferably about 0.06 inches thick.

In a preferred embodiment, work surface 110 comprises an erasable writing surface. As used throughout this specification and the appended claims, the term "erasable writing surface" refers to any work surface which allows a user to write or draw on the surface and which is erasable thereafter. Work surface 110, for example, allows the user to mark on the work surface with an erasable writing instrument such as a dry erase pen, then erase the markings. It will thus be appreciated that work surface 110 enables convenient writing or drawing directly on surface 110 and/or enables convenient writing or drawing onto an object such as a sheet of paper which is placed onto surface 110 for support.

As used throughout this specification and the appended claims the term "writing instrument" refers to any instrument which can be used to write, draw, paint, or otherwise leave markings on a work surface such as surface 110. Examples of writing instruments which may be employed to write on work surface 110 include markers, pens, pencils, paintbrushes, crayons, and other such instruments presently known within the art.

Furthermore, since work surface 110 preferably comprises a light permeable material, preferably a transparent material, a user is able to removably place an object, such as a substantially flat sheet 114 having insignia thereon, behind work surface 110. This enables a user to view the insignia on the sheet 114 through work surface 110, then trace the configuration of the insignia with an erasable marker, pen or other erasable writing instrument.

Work surface 110 may thus serve as a dry erase board allowing a user to continually draw and write on work surface 110, then erase surface 110 and draw figures over and over again. Children, for example, would enjoy tracing the insignia on sheet 114 such as a cartoon character or numbers or symbols, then erasing the tracings, then beginning to trace again. Work surface 110 may also be employed for painting and for manipulating small objects such as parts and supplies.

In one embodiment, sheet 114 comprises paper, cardboard, metal, plastic, or any material which contains an insignia thereon, such as a design, a cartoon, letters, a picture or other markings. Optionally, however, sheet 114 has no markings thereon and the space between work surface 110 and panel 112 is merely employed to store sheet 114. Thus, an embodiment of the invention having a panel, a work surface, and means for coupling the work surface to the panel serves as an organizer with a work surface.

Organizer 10 further comprises means for removably affixing sheet 114 to work surface 110. As one example of such removable affixing means, work surface 110 may be coupled tightly enough to front panel 112 of backpack pouch 12 by rim 111 that sheet 114 such as a piece of paper is maintained in a removably coupled position between backpack pouch 12 and transparent work surface 110.

As another example of removable affixing means, static electricity which builds up against the interior surface of work surface 110 serves to removably bind sheet 114 such as paper to the interior surface of work surface 110 while the user writes or draws on work surface 110. Since sheet 114 remains in such a fixed position, the user is able to write over and over again on work surface 110 and even erase if desired without losing the position of the insignia.

This build up of static electricity results at least in part from movement of sheet 114 between pouch 12 and work surface 110 as sheet 114 is placed therebetween, particularly because pouch 12 is comprised of a fabric material. High gloss paper is an example of paper which is particularly susceptible to the affixing action of the static electricity. Other examples of means for removably affixing sheet 114 to work surface 110 include clips coupled the interior surface of work surface 110 and adhesive tape.

Rim 111 is comprised of a rectangular sheet having a large aperture therein. The rectangular sheet is made from opposing side strips 144, 145 of material and upper and lower strips 146, 147 of material. Side strips 144, 145 and lower strip 147 are coupled to panel 112 along the entire length of the respective outer edges 148, 150, 152 thereof. Outer edges 148, 150, 152 are stitched to panel 112, for example. The respective inner edges thereof are disposed against work surface 110 and maintain work surface 110 against panel 112.

In the embodiment shown, although the ends thereof are coupled to side strips 144, 145, upper strip 146 of rim 111 is free and open, allowing work surface 110 to be placed under rim 111. Work surface 110 shown in FIG. 4 is thus removably coupled to panel 112 by rim 111, enabling the user to alternate surfaces. In another embodiment, the outer edge 154 of upper strip 146 is coupled along its length to panel 112, such as by being stitched thereto after work surface has been placed under rim 111, thereby permanently coupling work surface 110 to panel 112.

Rim 111 maintains work surface 110 tightly enough against pouch 12 that work surface 110 does not fall out of backpack 11, yet allows sheet 114 to be removably placed between work surface 110 and pouch 12. The ability of sheet 114 to fit between rim 111 and panel 112 is also caused in part by pouch 12 comprising a pliable, fabric material.

It will be appreciated that the term "fabric" as used throughout this specification and the appended claims refers to a pliable material which is made from individual strands, threads, fibers, or filaments, such as by being woven, knit, felted, or stitched. Examples of fabrics which may be employed for backpack 11 include nylon, GORTEX, cotton, polyester, wool, combinations of the same and other fabrics known to those skilled in the art.

As one optional feature, front panel 112 is a two-sided sheet of material. In the embodiment shown in FIGS. 4 and 5, front panel 112 of pouch 12 includes first sheet 115 and a second sheet 116. First sheet 115 defines an interior surface of the front portion of pouch 12 while second sheet 116 is disposed between work surface 110 and first sheet 115 and substantially forms an exterior surface of the front portion of pouch 12. In the embodiment shown in FIGS. 4 and 5, a small exterior portion of first sheet 115 encircles rim 111 and second sheet 116. The outer edges 148, 150 of respective side strips 144, 145 of rim 111 are stitched with an inner set of stitches into second sheet 116 and with an outer set of stitches into first sheet 115.

Second sheet 116, serves as a lining, providing a smoother material than first sheet 115 in order to protect first sheet 115 from sliding sheet 114 and to permit ready sliding of sheet 114 between panel 112 and work surface 110. For example, in one embodiment, second sheet 116 of backpack 11 is comprised of 200 Denier Nylon while the remainder of (i) backpack pouch 12, including first sheet 115; and (ii) flaps 58, 60 of backpack 11 are comprised of 600 Denier with a kiscoat for waterproofing purposes. Additional sheets of material for panel 112 may also be employed.

FIG. 4 further demonstrates elastic bands 117 coupled to rim 101 for receiving pencils or other writing instruments. Elastic bands are formed from a single band which is stitched in the middle thereof to form separate circular bands.

As shown in FIGS. 2, 3, 4 and 5, upper flap 25, couples to pouch 12 between rear panel 23 and front panel 112 while lower flap 26 couples to the lower end of pouch 12 between rear panel 23 and front panel 112 Side flaps 58, 60 are also coupled between front ends 62, 63 of rear panel 23 of pouch 12 and respective opposing sides of front panel 112. This coupling may be achieved through stitching, for example.

FIGS. 3–5 also demonstrate that pouch 32 of flap 25 is formed by flap 25 being comprised of first and second sheets 142 of material coupled together to form pouch 32.

In another embodiment, upper and lower flaps 25, 26 and first and second side flaps 58, 60 couple only to front panel 112 without rear panel 23. This alternative embodiment features the benefits of work surface 110 and flaps 25, 26, 58, 60 coupled to front panel 112 even without the pouch 12 created by the coupling of front panel 112 to rear panel 23.

It will be further appreciated from a view of FIG. 4 that the substantially rigid, substantially flat work surface 110, in combination with first and second side flaps 58, 60 forms a saddle bag configuration which is conveniently balanced on the lap of a user. Thus, while a user is in an automobile or other confined location, the user conveniently places the central portion of organizer 10 into the user's lap with first and second flaps 58, 60 draped onto opposing sides of the user's lap. The coupling means within upper and lower flaps 25, 26 and side flaps 58, 60 are thus strategically placed for ready access by the user. The user then has convenient access to the various objects contained within organizer 10 and can immediately and conveniently write or draw on surface or on a piece of paper or other object placed onto surface 110.

As yet another example of means for retaining first flap 58 in the folded position, a first attachment member is coupled to rim 111 and a second corresponding attachment member is coupled to first flap such that first flap is removably coupled to rim 111. The first and second attachment members may comprises hook and pile material, for example.

Figure 6:
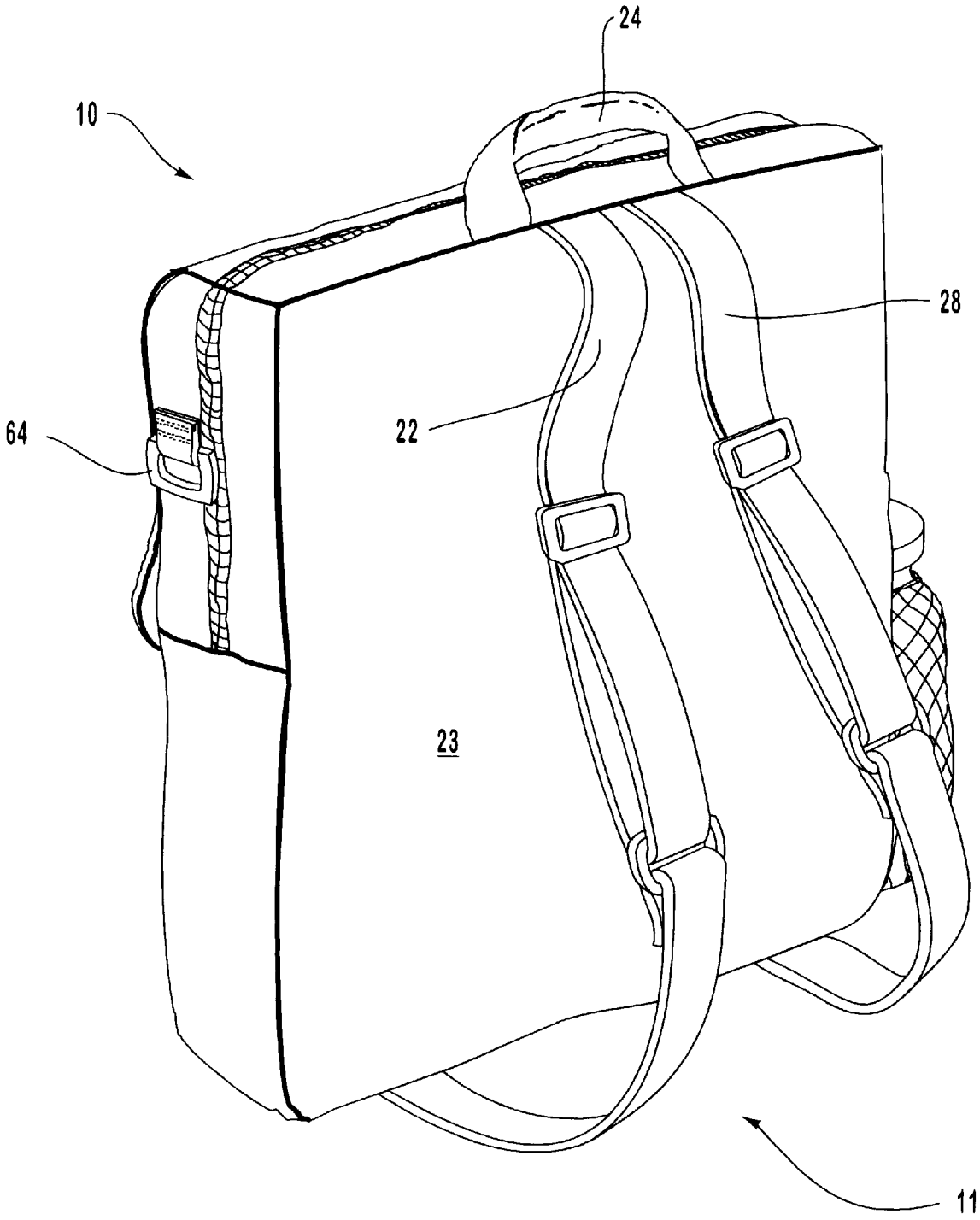
FIG. 6 demonstrates a rear perspective view of the backpack of FIG. 1.

With reference now to FIG. 6, organizer 10 is shown from a rear perspective view which features backpack 11 having handle 24, straps 22, 24, and ring 64 coupled to an exterior surface of backpack 11. A variety of other hooks and rings may be coupled to pouch 12. Supplemental pouches and packs, such as fanny packs may be coupled to backpack 11.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A backpack, comprising:

(a) a pouch having a rear portion and a front portion, the pouch further having (i) and open end that is selectively closed;

(b) at least one shoulder strap coupled to the rear portion of the pouch;

(c) a substantially flat, substantially rigid work surface which is selectively used to receive objects thereon or as a writing surface;

(d) means for coupling the substantially flat, substantially rigid work surface to the front portion of the pouch such that the work surface covers at least a substantial portion of the surface area of the front portion of the pouch, the means for coupling the work surface to the front portion of the pouch having an open, open end, and wherein a space exists between the work surface and the front portion of the pouch, the space enabling selective placement of a substantially flat sheet through the open end and between the work surface and the front portion of the pouch, said coupling means comprising a flaccid material; and (e) at least one flap coupled to one side of the pouch such that an interior surface of the at least one flap selectively folds in abutting relationship against the substantially flat work surface.

2. A backpack as recited in claim 1, further comprising a substantially flat sheet of paper that is selectively placed within the space existing between the work surface and the front portion of the pouch.

3. A backpack as recited in claim 1, wherein the work surface is transparent.

4. A backpack as recited in claim 1, wherein the at least one flap comprises a first flap and includes means for removably coupling an object to the flap, the means for removably coupling an object to the flap selectively folding against the work surface when the flap is in a folded position.

5. An organizer as recited in claim 4, wherein the means for removably coupling an object to the first flap comprises the interior surface of the first flap being configured to removably receive the object.

6. An organizer as recited in claim 4, further comprising:

(a) a second flap coupled to an opposing side of the pouch from the first flap, the second flap having an interior surface and an exterior surface, the interior surface of the second flap selectively folding against the first flap; and (b) means for removably coupling an object to the second flap.

7. An organizer as recited in claim 6, further comprising upper and lower flaps coupled to the pouch and means for removably coupling the upper flap to the lower flap, the upper and lower flaps selectively folding over the first and second side flaps.

8. An organizer as recited in claim 1, wherein the means for coupling the work surface to the pouch removably couples the work surface to the pouch.

9. A backpack as recited in claim 1, wherein the backpack further comprises a substantially flat sheet, and wherein the means for coupling the work surface to the pouch comprises a rim disposed about the periphery of the pouch for removably coupling the work surface to the pouch, the rim having a free, open upper end, a lower end coupled to the pouch, and first and second sides coupled to the pouch, the substantially flat sheet selectively extending through the free open upper end of the rim.

10. A backpack, comprising:

(a) a pouch having a rear portion and a front portion, the pouch further having an open end which may be selectively closed;

(b) at least one strap coupled to the rear portion of the pouch, the strap having an upper end coupled to a first portion of the pouch and a lower end coupled to a second portion of the pouch;

(c) a substantially flat, substantially rigid writing surface coupled to the front portion of the pouch, the writing surface covering at least a majority of the surface area of the front portion of the pouch;

(d) a first flap coupled to one side of the pouch;

(e) a second flap coupled to an opposing side of the pouch; and (f) upper and lower flexible members coupled to upper and lower portions of the pouch, respectively, the upper and lower members selectively, removably coupling to each other over the first and second flaps.

11. A backpack as recited in claim 10 wherein the upper and lower members comprise upper and lower flaps, respectively.

12. A backpack, comprising:

(a) a pouch having a rear portion and a front portion, the pouch further having an open end and a closing device configured to enable a user to selectively close the open end;

(b) first and second shoulder straps coupled to the rear portion of the pouch, each shoulder strap having an upper end coupled to an upper portion of the pouch and a lower end coupled to a lower portion of the pouch;

(c) a first flap coupled to a first side of the pouch; and (e) a substantially rigid organizing tray coupled to the first flap, the substantially rigid organizing tray configured to removably receive at least one object, the substantially rigid organizing tray having an upper portion that protrudes through and vertically above a surface of the first flap when the first flap is horizontally disposed, such that an object is selectively placed within the tray by lowering the object vertically into the tray when the first flap is horizontally disposed.

13. A backpack as recited in claim 12, further comprising a substantially flat, substantially rigid work surface which is selectively used to receive objects thereon or as a writing surface, the substantially rigid work surface being coupled to the front portion of the pouch such that the work surface covers at least a majority of the surface area of the front portion of the pouch, the first flap selectively folding such that the organizing tray is selectively oriented in an abutting relationship against the substantially flat work surface.

14. A backpack as recited in claim 12, further comprising:

(a) means for removably coupling an object to the interior surface of the second flap; and (b) means for removably coupling the first flap to the second flap.

15. A backpack as recited in claim 12, wherein the backpack comprises a fabric material and the tray is removably coupled to the first flap such that the tray is removably coupled to a fabric material.

16. A backpack as recited in claim 12, wherein the tray has a lip extending from a side thereof.

17. A backpack, comprising:

(a) a pouch having a rear portion and a front portion, the pouch further having an open end and a closing device configured to enable a user to selectively close the open end of the pouch;

(b) first and second shoulder straps coupled to the rear portion of the pouch, each strap having an upper end coupled to a first portion of the pouch and a lower end coupled to a second portion of the pouch;

(c) at least one flap coupled to one side of the pouch, the flap comprising a sheet of fabric having an opening therethrough; and (d) a substantially rigid organizing tray coupled to the at least one flap, the substantially rigid organizing tray configured to receive at least one object therein, the substantially rigid organizing tray having a lip extending from a side of the tray, the lip of the tray being disposed under a portion of the sheet while the side of the tray extends through the opening.

18. A backpack as recited in claim 17, wherein the at least one flap selectively folds in abutting relationship against the pouch.

19. A backpack as recited in claim 17, further comprising a substantially flat, substantially rigid work surface which is selectively used to receive objects thereon or as a writing surface, the work surface coupled to the front portion of the pouch.

20. A backpack comprising:

a pouch having a rear portion and a front portion, the pouch further having an open end that is selectively closed;

at least one shoulder strap coupled to the rear portion of the pouch;

a substantially flat, substantially rigid work surface; and a flaccid material for coupling the work surface to the front portion of the pouch such that the work surface covers at least a substantial portion of the surface area of the front portion of the pouch, wherein a space exists between the work surface and the front portion of the pouch, the space enabling selective placement of a substantially flat sheet between the work surface and the front portion of the pouch; and at least one flap coupled to one side of the pouch such that an interior surface of the at least one flap selectively folds in abutting relationship against the substantially flat work surface.

* * * * *